US009227438B2

(12) United States Patent
Takabatake et al.

(10) Patent No.: US 9,227,438 B2
(45) Date of Patent: Jan. 5, 2016

(54) PRINTER

(71) Applicant: FUJITSU COMPONENT LIMITED, Tokyo (JP)

(72) Inventors: Yoshinari Takabatake, Tokyo (JP); Sumio Watanabe, Tokyo (JP); Yukihiro Mori, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/451,525

(22) Filed: Aug. 5, 2014

(65) Prior Publication Data

US 2015/0062279 A1 Mar. 5, 2015

(30) Foreign Application Priority Data

Aug. 28, 2013 (JP) ..... 2013-177132

(51) Int. Cl.

| | |
|---|---|
| ***B41J 15/00*** | (2006.01) |
| ***B41J 11/66*** | (2006.01) |
| ***B41J 11/70*** | (2006.01) |
| ***B41J 11/04*** | (2006.01) |

(52) U.S. Cl.

CPC *B41J 11/70* (2013.01); *B41J 11/04* (2013.01); *B41J 11/66* (2013.01); *B41J 15/00* (2013.01); *B41J 2202/20* (2013.01)

(58) Field of Classification Search

USPC ..... 347/222

See application file for complete search history.

(56) References Cited

U.S. PATENT DOCUMENTS

| | | | | |
|---|---|---|---|---|
| 5,198,836 | A | 3/1993 | Saito et al. | |
| 6,744,457 | B2 | 6/2004 | Seino et al. | |
| 8,790,029 | B2 * | 7/2014 | Tsuchiya et al. | 400/621 |
| 2005/0036820 | A1 | 2/2005 | Watanabe et al. | |
| 2005/0207818 | A1 | 9/2005 | Tsuchiya et al. | |
| 2007/0296799 | A1 | 12/2007 | Watanabe et al. | |
| 2011/0236117 | A1 * | 9/2011 | Tsuchiya et al. | 400/621 |

FOREIGN PATENT DOCUMENTS

| | | |
|---|---|---|
| EP | 2540514 | 1/2013 |
| JP | H07-068866 | 3/1995 |
| JP | 2001-219618 | 8/2001 |
| JP | 2003-246104 | 9/2003 |
| JP | 2005-081774 | 3/2005 |

OTHER PUBLICATIONS

Computer-generated translation of JP 2001-219618, published on Aug. 2001.*

* cited by examiner

*Primary Examiner* — Huan Tran

(74) *Attorney, Agent, or Firm* — IPUSA, PLLC

(57) ABSTRACT

A printer includes a platen roller, a printer main block including a print head that prints information on recording paper placed between the print head and the platen roller, a movable-blade block including a movable blade, a fixed-blade block including a fixed blade, a feed driving block including a feed driving motor that rotates the platen roller to feed the recording paper, and a movable-blade driving block including a movable-blade driving motor that moves the movable blade. The printer main block, the platen roller, the movable-blade block, the fixed-blade block, the feed driving block, and the movable-blade driving block are detachably attached to each other to form the printer that includes a function to cut the recording paper with the fixed blade and the movable blade.

6 Claims, 8 Drawing Sheets

PRINTER

CROSS-REFERENCE TO RELATED APPLICATION

The present application is based upon and claims the benefit of priority of Japanese Patent Application No. 2013-177132, filed on Aug. 28, 2013, the entire contents of which are incorporated herein by reference.

BACKGROUND OF THE INVENTION

1. Field of the Invention

An aspect of this disclosure relates to a printer.

2. Description of the Related Art

Printers for printing receipts are widely used, for example, for cash registers in shops and stores, and for automated teller machines (ATM) and cash dispensers (CD) in banks. In a printer for printing receipts, for example, information is printed by a thermal head on recording paper (thermal paper) while the recording paper is being fed, and the recording paper is cut with a cutter at a predetermined length, i.e., after the predetermined length of the recording paper is fed.

Such a printer includes, for example, a printer body and a lid rotatably supported by the printer body. When the lid is opened, a roll of recording paper can be placed in the printer body. In this case, for example, a thermal head is disposed in the printer body and a platen roller is mounted on the lid. When the lid is closed, the recording paper is sandwiched between the thermal head and the platen roller. With the recording paper being sandwiched between the thermal head and the platen roller, information is printed on the recording paper by the thermal head (see, for example, Japanese Laid-Open Patent Publication No. 07-068866 and Japanese Laid-Open Patent Publication No. 2003-246104).

A printer is preferably configured such that only a broken part of the printer can be easily replaced. Such a configuration makes it possible to reduce maintenance time and out-of-service time, and improve usability. Also, a printer is preferably configured such that it can be converted into different types of printers by replacing components of the printer. Such a configuration makes it possible to use a printer for various purposes and improve usability.

SUMMARY OF THE INVENTION

In an aspect of this disclosure, there is provided a printer that includes a platen roller, a printer main block including a print head that prints information on recording paper placed between the print head and the platen roller, a movable-blade block including a movable blade, a fixed-blade block including a fixed blade, a feed driving block including a feed driving motor that rotates the platen roller to feed the recording paper, and a movable-blade driving block including a movable-blade driving motor that moves the movable blade. The printer main block, the platen roller, the movable-blade block, the fixed-blade block, the feed driving block, and the movable-blade driving block are detachably attached to each other to form the printer that includes a function to cut the recording paper with the fixed blade and the movable blade.

DESCRIPTION OF EMBODIMENTS

Embodiments of the present invention are described below with reference to the accompanying drawings. The same reference number is assigned to the same component throughout the accompanying drawings, and overlapping descriptions of the same component are omitted.

An aspect of this disclosure provides a printer that is formed by combining component blocks and that can be easily converted into different types of printers depending on purposes by replacing the component block.

<Printer>

A printer according to an embodiment is described with reference to FIGS. 1 and 2. According to the present embodiment, printer components are combined into blocks, and a printer can be assembled by combining the blocks. The printer of the present embodiment includes a cutting function for cutting recording paper that is implemented by a movable-blade block 30, a fixed-blade block 40, and a movable-blade driving block 60. The printer can be converted into a cutterless printer, which does not include a function to cut recording paper, by removing the movable-blade block 30, the fixed-blade block 40, and the movable-blade driving block 60.

Figure 1:
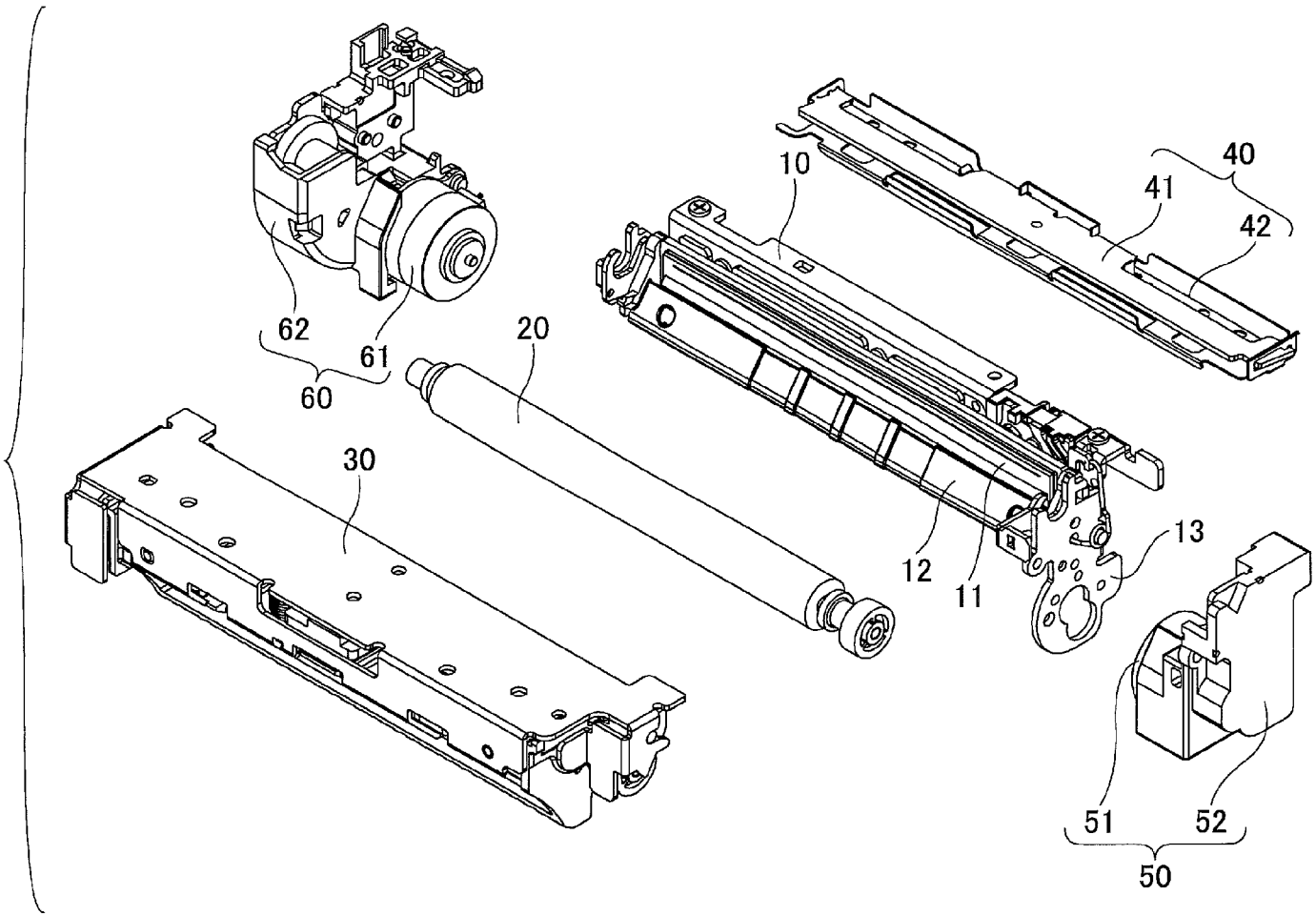
FIG. 1 is an exploded perspective view of a printer of an embodiment.

As illustrated by FIG. 1, the printer of the present embodiment includes a printer main block 10, a platen roller 20, the movable-blade block 30, the fixed-blade block 40, a feed driving block 50, and the movable-blade driving block 60.

The printer main block 10 includes a thermal head 11 that is a print head, a recording paper guide 12, and a frame 13. The thermal head 11 prints information on recording paper such as thermal paper that is sandwiched between the thermal head 11 and the platen roller 20. The recording paper guide 12 forms a path along which the recording paper is conveyed, and is disposed such that the recording paper is fed into a space between the thermal head 11 and the platen roller 20.

The movable-blade block 30 includes a movable blade (not shown) and gears (not shown) for moving the movable blade. The fixed-blade block 40 includes a fixed blade 41 and a fixed-blade spring part 42. The fixed blade 41 is disposed on the fixed-blade spring part 42. The fixed blade 41 is biased upward in FIG. 1 by the restoring force of a spring (not shown) of the fixed-blade spring part 42. The recording paper is cut by the movable blade of the movable-blade block 30 and the fixed blade 41 by moving the movable blade toward the fixed blade 41. When the recording paper is cut, the fixed blade 41 is biased toward the movable blade by the restoring force of the spring of the fixed-blade spring part 42.

The feed driving block 50 includes a feed driving motor 51 and a gear box 52. The platen roller 20 is rotated via gears (not shown) of the gear box 52 when the feed driving motor 51 of the feed driving block 50 rotates.

The movable-blade driving block 60 includes a movable-blade driving motor 61 and a gear box 62. The movable blade of the movable-blade block 30 is moved toward the fixed blade 41 via gears (not shown) of the gear box 62 when the movable-blade driving motor 61 rotates. As a result, the recording paper is cut by the movable blade of the movable-blade block 30 and the fixed blade 41.

Figure 2:
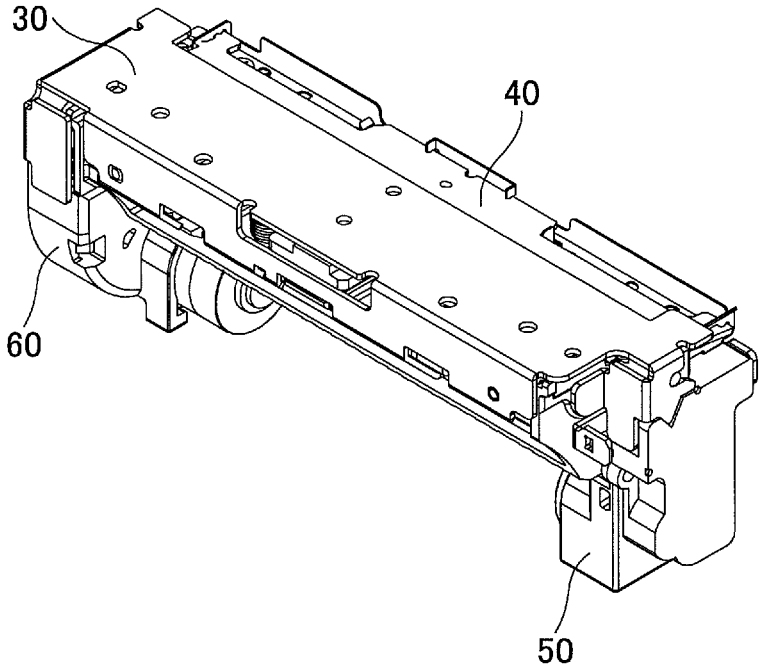
FIG. 2 is a perspective view of a printer of an embodiment.

According to the present embodiment, the platen roller 20, the movable-blade block 30, the fixed-blade block 40, the feed driving block 50, and the movable-blade driving block 60 are detachably attached, for example, to the frame 13 of the printer main block 10 to form the printer as illustrated by FIG. 2.

According to the present embodiment, the printer main block 10 can be replaced with another printer main block 10 including a thermal head 11 with a different specification. For example, a printer main block 10 including a thermal head 11 with a resolution of 200 dpi can be replaced with a printer main block 10 including a thermal head 11 with a resolution of 300 dpi. This configuration makes it possible to easily change specifications of a printer by exchanging blocks. The shapes and basic configurations of the printer main block 10 with a resolution of 200 dpi and the printer main block 10 with a resolution of 300 dpi, particularly those of parts of the printer main blocks 10 to which other components are attached, are preferably the same to make it easier to exchange the printer main blocks 10. This also applies to other blocks of the printer. As another example, a printer main block 10 including a low-voltage thermal head 11 can be replaced with a printer main block 10 including a high-speed thermal head 11.

Also, the feed driving block 50 can be replaced with another feed driving block 50 including a feed driving motor 51 and/or a gear box 52 with a different specification to change the speed, the amount, and/or the torque of feeding the recording paper.

Also, the movable-blade driving block 60 can be replaced with another movable-blade driving block 60 including a movable-blade driving motor 61 and/or a gear box 62 with a different specification, e.g., a different torque, to use recording paper with a different thickness.

Figure 3:
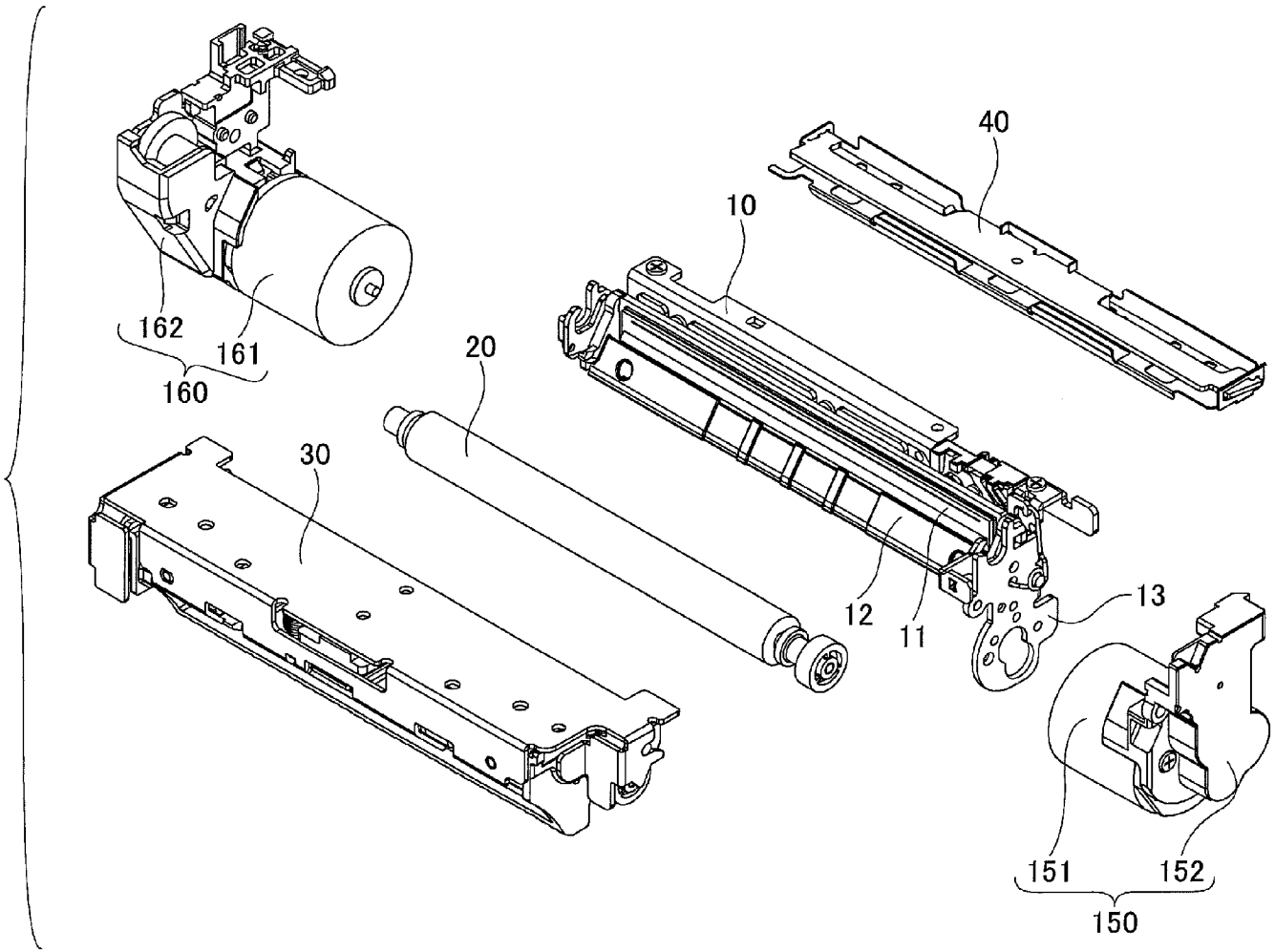
FIG. 3 is an exploded perspective view of a printer of an embodiment.
Figure 4:
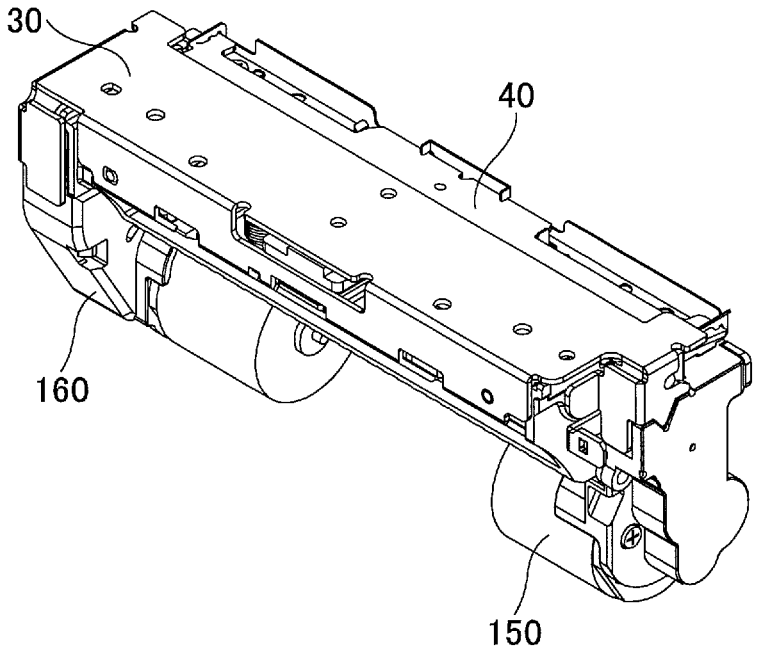
FIG. 4 is a perspective view of a printer of an embodiment.

FIG. 3 illustrates an exemplary case where a printer with desired specifications is formed by combining the printer main block 10, the platen roller 20, the movable-blade block 30, the fixed-blade block 40, a feed driving block 150, and a movable-blade driving block 160. The feed driving block 150 is a replacement of the feed driving block 50 of FIG. 1, and includes a feed driving motor 151 and a gear box 152 that are larger than the feed driving motor 51 and the gear box 52 of the feed driving block 50. The movable-blade driving block 160 is a replacement of the movable-blade driving block 60 of FIG. 1, and includes a movable-blade driving motor 161 and a gear box 162 that are larger than the movable-blade driving motor 61 and the gear box 62 of the movable-blade driving block 60. When the specifications of the printer of FIG. 2 are changed, the feed driving block 50 is detached from the frame 13, and the feed driving block 150 is attached to the frame 13. Similarly, the movable-blade driving block 60 is detached from the frame 13, and the movable-blade driving block 160 is attached to the frame 13. As a result, a printer with specifications different from the specifications of FIG. 2 is formed.

In the above example, the feed driving block 50 and the movable-blade driving block 60 are replaced with the feed driving block 150 and the movable-blade driving block 160 to change the specifications of the printer. However, the printer main block 10, the platen roller 20, the movable-blade block 30, and the fixed-blade block 40 may also be replaced with the corresponding blocks or components to form a printer with different specifications.

<Cutter-Less Printer>

Figure 5:
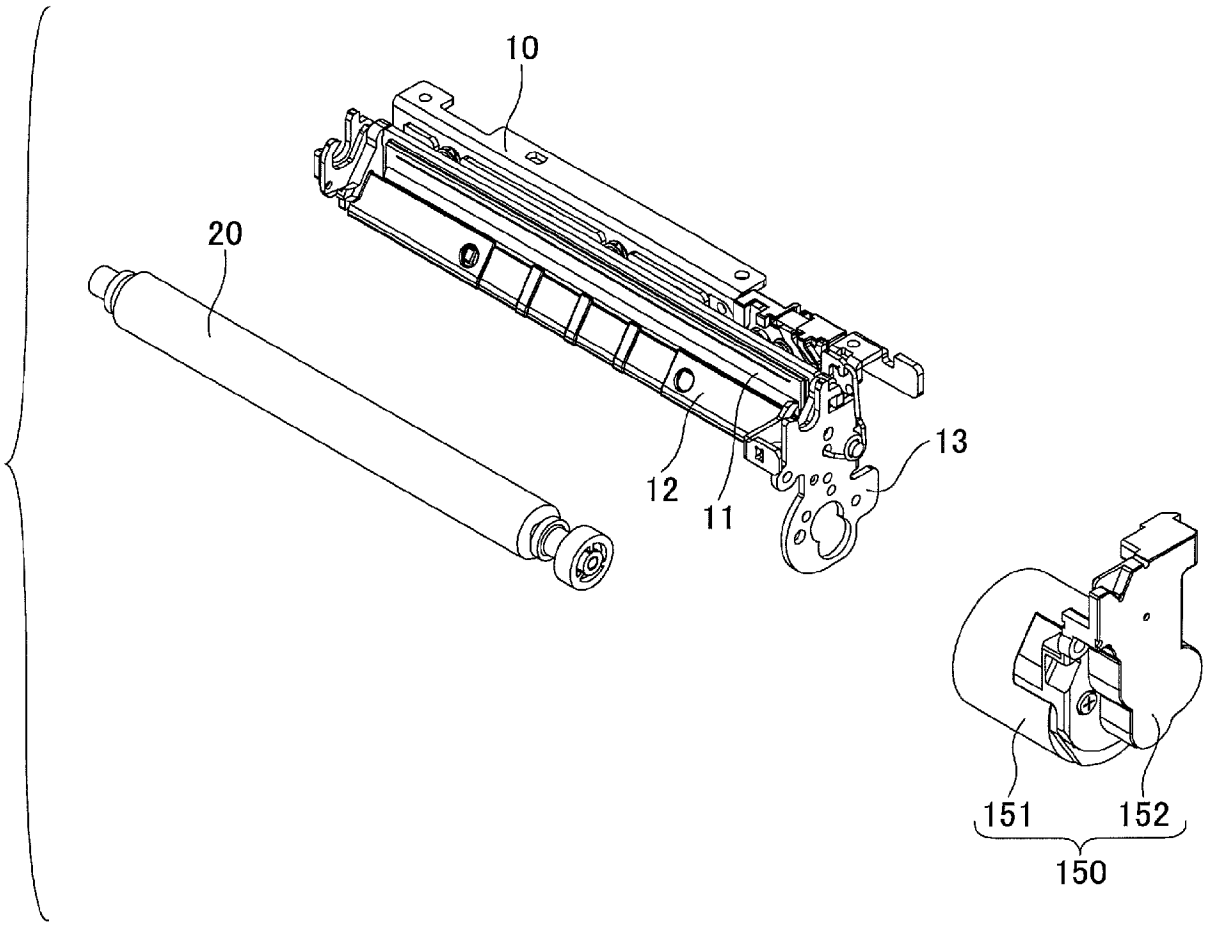
FIG. 5 is an exploded perspective view of a printer of an embodiment.

Next, a cutter-less printer without a cutter is described. A cutter-less printer can be formed by combining the printer main block 10, the platen roller 20, and the feed driving block 150 illustrated in FIG. 3. More specifically, a cutter-less printer as illustrated by FIG. 6 can be formed by combining the printer main block 10, the platen roller 20, and the feed driving block 150 illustrated by FIG. 5.

Figure 6:
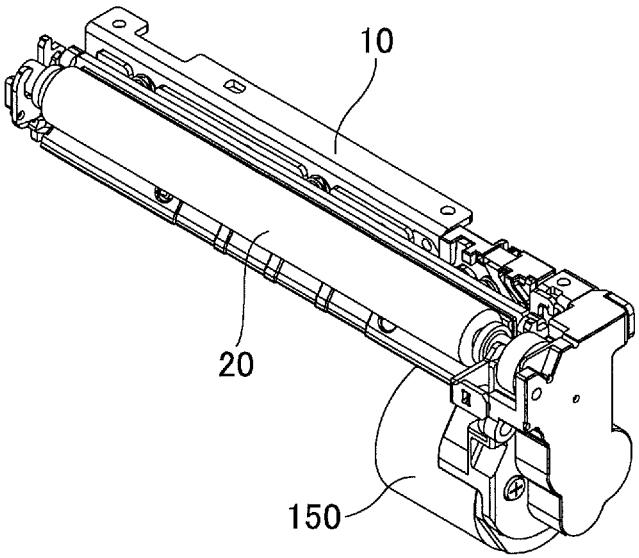
FIG. 6 is a perspective view of a printer of an embodiment.
Figure 7:
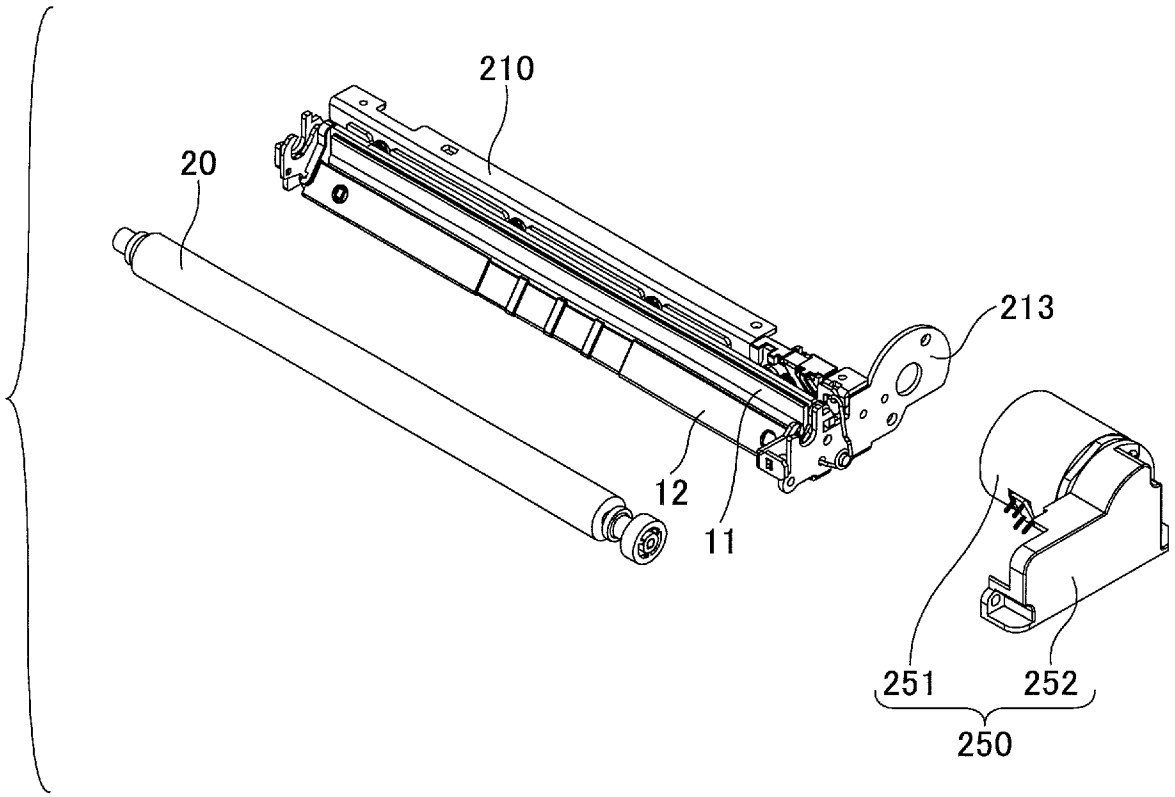
FIG. 7 is an exploded perspective view of a printer of an embodiment.

In the printer of FIG. 6, the feed driving block 150 is disposed in a vertical position (i.e., the feed driving block 150 is long in the vertical direction in FIG. 6). Alternatively, a printer may be formed such that a feed driving block is disposed in a horizontal position. FIG. 7 illustrates a printer main block 210 including a frame 213 that is disposed in a horizontal position (i.e., that is long in the horizontal direction in FIG. 7), and a feed driving block 250 that is configured to be disposed in a horizontal position. The printer main block 210, the feed driving block 250, and the platen roller 20 are combined to form a cutter-less printer of FIG. 8 where the feed driving block 250 is disposed in a horizontal position. The feed driving block 250 includes a feed driving motor 251 and a gear box 252 configured to be disposed in a horizontal position. Although a horizontally-positioned cutter-less printer is described above with reference to FIGS. 7 and 8, a horizontally-positioned printer with a cutter may also be formed in a similar manner.

Figure 8:
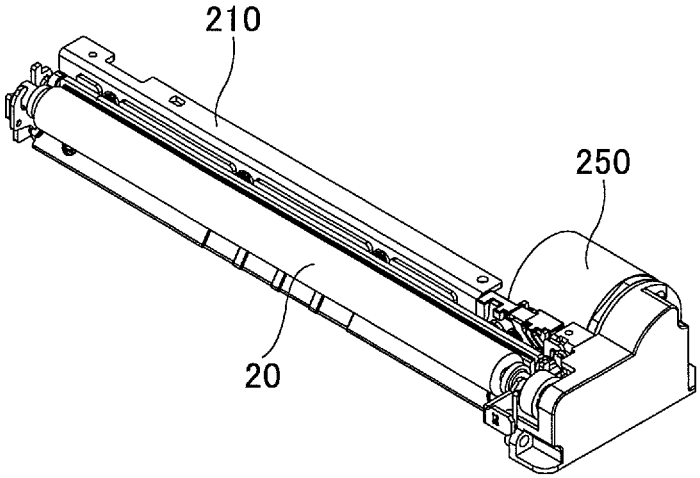
FIG. 8 is a perspective view of a printer of an embodiment.

In the printers of FIG. 6 and FIG. 8, no component is provided in place of the movable-blade block 30. However, a block that does not include a movable blade but has an appearance and a shape similar to those of the movable-blade block 30 may be provided in place of the movable-blade block 30.

Printers according to embodiments are described above. However, the present invention is not limited to the specifically disclosed embodiments, and variations and modifications may be made without departing from the scope of the present invention.

What is claimed is:

1. A printer, comprising:

a printer main block, the printer main block including
- a frame,
- a print head provided on the frame, for printing information on recording paper, and
- a platen roller rotatably provided on the frame;

a movable-blade block detachably attachable to the frame, the movable-blade block including a movable blade;

a fixed-blade block detachably attachable to the frame so as to face the movable-blade block with the printer main block provided between the movable-blade block and the fixed-blade block, the fixed-blade block including a fixed blade;

a feed driving block detachably attachable to a first longitudinal end of the frame, the feed driving block includes a feed driving motor for rotating the platen roller to feed the recording paper, and a first transmission for transmitting rotation of the feed driving motor to the platen roller; and a movable-blade driving block detachably attachable to a second longitudinal end of the frame, the movable-blade driving block includes a movable-blade driving motor for moving the movable blade, and a second transmission for transmitting rotation of the movable-blade driving motor to the movable blade.

2. The printer as claimed in claim 1, wherein the printer is convertible into a printer without a function to cut the recording paper by detaching the movable-blade block, the fixed-blade block, and the movable-blade driving block.

3. The printer as claimed in claim 1, wherein the printer main block is replaceable with another printer main block including a print head with a different specification.

4. The printer as claimed in claim 1, wherein the feed driving block is replaceable with another feed driving block with a different specification.

5. The printer as claimed in claim 1, wherein the movable-blade driving block is replaceable with another movable-blade driving block with a different specification.

6. A printer, comprising:

a printer main block, the printer main block including a frame, a print head provided on the frame, for printing information on a recording medium, and a platen roller rotatably provided on the frame, wherein the printer is configured such that one or more of the following blocks are detachably attachable to the printer main block:

a fixed-blade block detachably attachable to the frame, the fixed-blade block including a fixed blade;

a movable-blade block detachably attachable to the frame so as to face the fixed-blade block with the printer main block provided between the movable-blade block and the fixed-blade block, the movable-blade block including a movable blade that is movable relative to the fixed blade;

a feed driving block detachably attachable to a first longitudinal end of the frame, the feed driving block includes a feed driving motor for driving the platen roller to feed the recording medium and a feed transmission for transmitting a driving force of the feed driving motor to the platen roller; and a movable-blade driving block detachably attachable to a second longitudinal end of the frame, the movable-blade driving block includes a movable-blade driving motor for moving the movable blade and a movable-blade transmission for transmitting a driving force of the movable-blade driving motor to the movable blade.

* * * * *